US009004877B2

(12) United States Patent
Becker et al.

(10) Patent No.: US 9,004,877 B2
(45) Date of Patent: Apr. 14, 2015

(54) MULTI-STAGE DIAPHRAGM SUCTION PUMP

(75) Inventors: Erich Becker, Bad Krozingen (DE); Erwin Hauser, Emmendingen (DE)

(73) Assignee: KNF Neuberger GmbH, Freiburg (DE)

( * ) Notice: Subject to any disclaimer, the term of this patent is extended or adjusted under 35 U.S.C. 154(b) by 56 days.

(21) Appl. No.: 13/499,020

(22) PCT Filed: Aug. 18, 2010

(86) PCT No.: PCT/EP2010/005061

§ 371 (c)(1),
(2), (4) Date: Mar. 29, 2012

(87) PCT Pub. No.: WO2011/038807

PCT Pub. Date: Apr. 7, 2011

(65) Prior Publication Data

US 2012/0189468 A1 Jul. 26, 2012

(30) Foreign Application Priority Data

Sep. 29, 2009 (DE) ..... 10 2009 043 644

(51) Int. Cl.

| | |
|---|---|
| ***F04B 23/06*** | (2006.01) |
| ***F04B 43/06*** | (2006.01) |
| ***F04B 19/00*** | (2006.01) |
| ***F04B 39/10*** | (2006.01) |
| ***F04B 43/04*** | (2006.01) |
| ***F04B 45/04*** | (2006.01) |
| ***F04B 45/047*** | (2006.01) |

(52) U.S. Cl.

CPC ..... *F04B 19/006* (2013.01); *F04B 39/1073* (2013.01); *F04B 43/043* (2013.01); *F04B 45/043* (2013.01); *F04B 45/047* (2013.01)

(58) Field of Classification Search

USPC ..... 417/521, 481, 482, 395, 244, 266, 62

See application file for complete search history.

(56) References Cited

U.S. PATENT DOCUMENTS

| | | | | |
|---|---|---|---|---|
| 3,947,156 | A * | 3/1976 | Becker | 417/437 |
| 2005/0271525 | A1 * | 12/2005 | Muramatsu et al. | 417/413.1 |

FOREIGN PATENT DOCUMENTS

| | | | | |
|---|---|---|---|---|
| DE | 20007811 | 8/2000 | | |
| DE | 10021454 | 11/2001 | | |
| DE | 19851680 | 4/2003 | | |
| DE | 102006043159 | * 11/2007 | | F04B 39/10 |
| DE | 102007057945 | 11/2009 | | |
| WO | 9906699 | 2/1999 | | |
| WO | 2004088138 | 10/2004 | | |

* cited by examiner

*Primary Examiner* — Bryan Lettman
(74) *Attorney, Agent, or Firm* — Volpe and Koenig, P.C.

(57) ABSTRACT

A multi-stage diaphragm suction pump, includes at least two pump chambers, each having a inlet having at least one inlet valve, and a outlet having at least one outlet valve, and a suction line, which connects the fluid inlets of the pump chambers. Successive pump chambers are connected to one another by at least one connection line such that, when a differential pressure in the suction line is reached/exceeded, the diaphragm pump changes from parallel to an operating mode that is at least also serial. At least one check valve, which opens to a downstream pump stage, is interposed in each of the inflow and outflow regions of the at least one connection line. A suction-side opening or a pressure-side opening of the connection line is arranged in a region of the pump chamber on which a diaphragm associated with the pump chamber rolls first during a pump cycle.

11 Claims, 9 Drawing Sheets

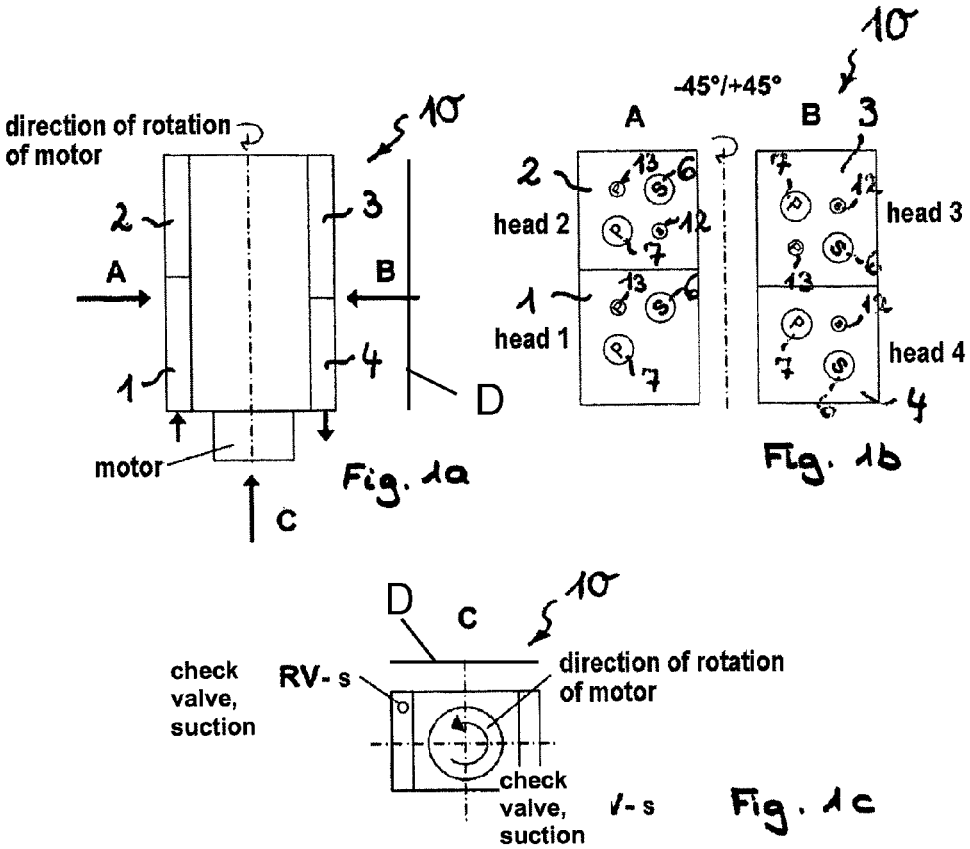
"low intake pressure"

"high suction capacity"

$d \leq 50\% D$

MULTI-STAGE DIAPHRAGM SUCTION PUMP

BACKGROUND

The invention relates to a multi-stage diaphragm suction pump, comprising at least two pump chambers, each having a fluid inlet having at least one inlet valve, and a fluid outlet having at least one outlet valve, and comprising a suction line, which connects the fluid inlets of the pump chambers, wherein successive pump chambers are each connected to one another by means of at least one connection line in such a way that, when a differential pressure in the suction line is reached/exceeded, the diaphragm pump changes from parallel operation of the pump chambers thereof to an operating mode of said pump chambers that is at least also serial, and wherein at least one check valve, which opens to the downstream pump stage, is interposed in each of the inflow and outflow regions of the at least one connection line.

During the evacuation of an autoclave, for example, the desire is, on the one hand, for a high delivery rate and, on the other hand, for a good ultimate vacuum. The high delivery rate is achieved by connecting the heads in parallel, while the good ultimate vacuum is achieved by multi-stage operation, i.e. by connection in series. In many applications, especially in laboratories, a low ultimate pressure is required, and this can only be achieved with a multi-stage arrangement.

WO 2004/088138 has already disclosed a micro vacuum pump which has two pump chambers, each delimited by an oscillating pump diaphragm. Each of these pump chambers has a fluid inlet having an inlet valve, and a fluid outlet having an outlet valve, wherein a suction line, which connects the fluid inlets of the pump chambers, and a pressure line, which connects the fluid outlets, are provided. The pump chambers are connected to one another by means of a connection line in such a way that, when a defined differential pressure in the suction line is reached and exceeded, the known micro vacuum pump changes from parallel operation of the pump chambers thereof to serial operation of said pump chambers. A check valve, which opens to the downstream pump stage, is interposed both in the inflow region and in the outflow region of the connection line. In order to reduce the outlay involved in the production of the known diaphragm suction pump, the check valves interposed in the connection line are similar in size to the inlet and outlet valves of the two pump chambers. Accordingly, the dimensions of the connection line segment provided between one of the check valves, on the one hand, and the adjacent pump chamber, on the other hand, are also similar. In order nevertheless to be able to pass the fluid flow initially via the parallel-connected inlet and outlet valves in the starting phase of a pumping operation, a restrictor which loses its restricting action only when an appropriate pressure difference and a reduced pump output are reached is interposed in the connection line.

At the beginning of the suction process, the known micro vacuum pump adopts a configuration for parallel operation of the pump chambers thereof because the restrictor provided in the connection line has the effect that the system can initially configure itself more easily for parallel operation, owing to the absence of hindrances to air circulation at that point in time. As soon as this configuration for parallel operation enters the ultimate vacuum range and the pressure difference in the suction line therefore reaches a maximum, it is much easier for the fluid to flow through the restrictor situated in the connection line and, as a result, it is simultaneously also configured for serial operation of the pump chambers thereof in order then to achieve a maximum possible ultimate vacuum.

However, the disadvantage is that the check valves of the known diaphragm pump are similar in size to the inlet and outlet valves and that the connection line segments which are provided between the check valves have a correspondingly large clear line cross section, with the result that there is a correspondingly large dead space in these line segments, which has an effect on the achievable ultimate vacuum of the known diaphragm suction pump and has a negative effect on the changeover point between parallel and serial operation.

In order to achieve as high as possible an ultimate vacuum within the shortest possible time and in order to approximate to the optimum changeover point between parallel and serial operation, another solution already adopted is to provide a multi-stage diaphragm pump in which the check valves provided in the inflow and in the outflow region of the connection line(s) are made smaller than the inlet and outlet valves of the pump chambers, and said check valves are each assigned a connection line segment which is open toward the adjacent pump chamber and has a smaller clear line cross section than the inlet and outlet valves (cf. DE 10 2007 057 945 A1). From a comparison of FIGS. 1 and 2 and the 90° sectional representation in FIG. 4 of DE 10 2007 057 945 A1, it will be clear that the inlet and outlet openings of the connection lines are arranged in the crank axis plane in this known diaphragm pump too. In the at least one connection line, which connects the pump chambers thereof to one another, this known diaphragm pump has check valves both on the inflow side and on the outflow side, and these valves are of considerably smaller dimensions than the inlet and outlet valves of said pump chambers. Since the moving valve element of these check valves can thus also have lower moving masses and accordingly can respond more quickly, an approximation to the optimum changeover point between parallel and serial operation is significantly promoted. Since the connection line only takes effect in the region of the optimum changeover point and since the connection lines have only to cope with comparatively small delivery rates in this pumping phase, the clear cross section of the connection lines can be made comparatively small in comparison with the suction and the pressure line. This also enables the check valves provided in the at least one connection line to be embodied with a very small flow cross section and with a correspondingly small diameter in comparison with the suction and pressure valves. Owing to the low mass of the moving valve or shutoff element of the check valves, these check valves can thus respond quickly when the suction and pressure valves close, and thereby prevent the diaphragm pump already known from DE 10 2007 057 945 A1 from delivering only an inadequate output or none at all in a transitional range of the pressure differences. Since each of the check valves is assigned a line segment leading to the adjacent pump chamber which has a significantly smaller clear line cross section than the inlet and outlet valves, the dead space remaining between a check valve, on the one hand, and the adjacent pump chamber, on the other hand, can be kept so small that even the production of a very low ultimate vacuum as possible to be produced in as short a time as possible by comparatively simple technical means.

DE 10 2006 043 159 B3 has already disclosed a two-stage vacuum pump for superheated steam, which has diaphragms acting in opposition as pumping members. The two pump chambers have inlets and outlets which are fitted with check valves and are each connected to one another in parallel by lines. The pump chambers are connected by means of a control line, which contains a check valve arrangement. In order to produce a high ultimate vacuum as quickly as possible, DE 10 2006 043 159 B3 makes provision for the valve members of the check valve arrangement associated with the connection line to have a significantly lower mass than the valve members of the check valves associated with the inlets and outlets of the pump chambers.

The pressure- and the suction-side openings of the connection line in the diaphragm pump already known from DE 10 2006 043 159 B3 are also provided approximately centrally between the pressure and suction valves of the pump chambers, on a line arranged axially parallel with the axis of rotation of the connecting rod. Since the working diaphragm which rolls on the pump chamber wall reaches the openings of the connection line approximately only in the end position thereof in each pump chamber, leakage flows can escape via said openings of the connection line, exerting an unfavorable effect on the performance of said diaphragm pumps.

The situation revealed by FIGS. 2*a* and 2*b* in cited document DE 10 2006 043 159 B3 is no different. In FIGS. 2*a* and 2*b* of DE 10 2006 043 159 B3 namely, only the fluid inlets and outlets connected to the pump chambers are shown in longitudinal section in the region of the check valves 1.5 and 1.6 thereof, while the suction- and pressure-side openings of the connection line connecting the pump chambers, which openings are arranged outside the section plane, are not shown and are not visible. These openings are instead visible in the region of the control valves 1.7 and 2.7 thereof in the partially cross-sectioned plan view in FIG. 3. In this figure, the suction- and pressure-side openings of the connection line connecting the pump chambers to one another are also provided approximately centrally between the pressure and the suction valves of the pump chambers, on a line arranged axially parallel with the axis of rotation of the connecting rod.

In the diaphragm pumps already known from WO 2004/088138 and from DE 10 2007 057 945 A1, the pressure- and the suction-side openings of the connection lines are provided approximately centrally between the pressure and the suction valves of the pump chambers, on a line arranged axially parallel to the axis of rotation of the connecting rod. Since the working diaphragm which rolls on the pump chamber wall reaches the openings of the connection lines approximately only in the end position thereof in each pump chamber, leakage flows can escape via said openings of the connection lines, exerting an unfavorable effect on the performance of said diaphragm pumps.

SUMMARY

It is therefore the object to provide a multi-stage diaphragm pump of the type mentioned at the outset which is distinguished by optimized pump characteristics in respect of the intake pressure or the suction capacity thereof.

In the case of the multi-stage diaphragm pump of the type mentioned at the outset, a solution to this object as specified by the invention, consists, in particular, in that either, in order to improve the intake pressure, the suction-side opening of the at least one connection line or, in order to improve the suction capacity, the pressure-side opening of the at least one connection line at least in one pump chamber is arranged in the region of the pump chamber on which the diaphragm associated with said pump chamber rolls first during a pump cycle.

The pump chambers of the diaphragm pump according to the invention are connected to one another by means of connection lines. The successive pump chambers in the delivery direction also have a suction-side opening which is associated with a connection line. To improve the intake pressure, the suction-side opening of at least one connection line, which opening is provided in at least one of the successive pump chambers, can be arranged in the region of the pump chamber, or in the vicinity of the region of the pump chamber, in which the diaphragm associated with said pump chamber rolls first during a pump cycle. In this embodiment, therefore, the measure taken to improve the intake pressure is to turn the arrangement of the suction-side opening of the at least one connection line out of the center line, which is oriented transversely to the connecting rod swivel plane at top dead center, preferably by about −45° in a direction toward the region of the pump chamber in which the diaphragm associated with said pump chamber rolls first during a pump cycle. The changeover from parallel to serial pump operation of the multi-stage diaphragm pump takes place namely when the intake pressure in the following stage is lower than the discharge pressure in the previous stage. To allow this effect to occur, the crank angles of the crank mechanism associated with the connecting rod must be arranged offset from head to head, preferably by 180°. The closer the small suction-side opening of a connection line then lies to the connecting rod oscillation plane, more specifically on the side of the sealing space on which the connecting rod is deflected in the direction of rotation by the tilting motion of the connecting rod during the upward stroke, and through the proximity to the connecting rod oscillation plane, the lower is the resulting intake pressure. The lowest intake pressure in the next stage is obtained if the small suction-side opening of at least one connection line lies precisely in the connecting rod oscillation plane. Each position between the zero point and the connecting rod oscillation plane results in a specific intake pressure. In this way, it is possible to influence the transition from the suction curve of the pump when connected in parallel to the suction curve when the pump is connected in series. In this case, it is possible to exert an influence even if the arrangement of the suction-side opening is altered in the direction mentioned in only one of the pump stages. The process begins in the first pump stage and progresses gradually via the other heads and pump stages. By means of the swivel angle, or variation thereof if required, in the arrangement of the suction-side opening of the connection lines connecting the pump stages to one another in the direction of the connecting rod oscillation plane, it is possible to influence the transitional range in the curve profile of the intake pressure and the suction capacity.

If, instead, the intention is to improve the suction capacity, it is also possible, at least in one pump stage, to arrange the pressure-side opening of the at least one connection line in the region of the pump chamber, or in the vicinity of the region of the pump chamber, on which the diaphragm associated with said pump chamber rolls first during a pump cycle. To improve the suction capacity, it is thus possible to turn the arrangement of the pressure-side opening of the at least one connection line out of the center line, which is oriented transversely to the connecting rod swivel plane at top dead center, preferably by about +45° in a direction toward the region of the pump chamber in which the diaphragm associated with said pump chamber rolls first during a pump cycle. Since, in this embodiment, the pressure-side connection line opening provided in said pump chamber is closed early by the working diaphragm rolling on the pump chamber wall, any leakage flows, which otherwise pass via the connection lines, can be significantly reduced and the suction capacity improved.

A preferred embodiment according to the invention envisages that a connecting rod that can be pivoted in a connecting rod oscillation plane is assigned to each pump chamber of the diaphragm pump, and that, at least in one pump chamber, the suction-side or the pressure-side opening of at least one connection line is provided in the connecting rod oscillation plane.

Optimization of the pump characteristics is additionally promoted if the suction-side or the pressure-side opening of the at least one connection line is arranged in the edge region of the pump chamber, which adjoins the clamping zone of the diaphragm.

A preferred embodiment according to the invention envisages that, at least in one pump chamber, the suction-side or the pressure-side opening of the at least one connection line and the suction valve are arranged approximately on a line extending transversely to the connecting rod oscillation plane.

As vacuum pumps, such multi-stage diaphragm suction pumps are often used for pumping off moisture-laden vapors. In unfavorable pressure and temperature conditions, condensate may form in the last and the preceding stages. This is generally prevented by the use of a gas ballast valve. However, depending on the evaporation properties of the condensate, such a gas ballast valve may lead to a considerable deterioration in the ultimate vacuum.

One method for achieving the maximum ultimate vacuum despite the formation of condensate is to blow out the condensate which arises at atmospheric pressure (cf. DE 198 51 680 C2 and DE 100 21 454 A1). However, one disadvantage of this method is the interruption in the evacuation process during blow-out.

In the parallel mode of the multi-stage diaphragm suction pumps mentioned at the outset, the maximum ultimate pressure is usually higher than the evaporation pressure of the condensate. For this reason, the condensate does not yet have any influence on the evacuation process. In the serial mode of such diaphragm suction pumps, however, the ultimate pressure of the pump often falls below the evaporation point of the condensate, with the result that it is not possible to achieve the ultimate pressure owing to the re-expansion of the condensate. The condensate must therefore be blown out continuously.

It is expedient if at least one connection line, in particular between successive pump chambers, has a descending line progression and if, for this purpose, the inflow-side line segment of said at least one connection line is arranged at a higher level in comparison with the outflow-side line segment. This descending arrangement of the at least one connection line, in particular connection line provided between successive pump chambers, makes it easier to blow out any condensate which arises in the successive pump chambers and additionally enhances the pump characteristic of the diaphragm suction pump according to the invention in respect of the suction capacity thereof. In this arrangement, the condensate usually occurs close to atmospheric pressure and thus generally in the last three stages of the series-connected pump chambers of the multi-stage diaphragm suction pump. A diaphragm pump configured in accordance with this proposal of the invention is distinguished by a continuous evacuation process, even though any condensate is continuously blown out by the working gas itself.

In the case of two- or multi-head pumps, the opposed configuration is an appropriate space-saving design. A preferred embodiment according to the invention therefore envisages that the pump stages of the multi-stage diaphragm pump are arranged in pairs in an opposed configuration.

In the case of an opposed configuration arranged horizontally, the heads, which are parallel to the axis, can easily be connected up horizontally on both sides.

However, if the aim is, in accordance with the proposal of the invention mentioned at the outset, to optimize the suction curve by modifying the changeover pressures by means of an offset arrangement of the connection line openings provided in the pump chamber, the suction-side connection line openings situated in the heads mounted on both sides of the pump housing must be arranged in the direction of the connecting rod oscillation plane and on the side of the head on which the connecting rod is deflected in the direction of rotation by the tilting movement during the upward stroke. As a result, the suction-side opening comes to lie above the axis in the second pump stage, while the pressure-side opening can be positioned below the axis in the third pump stage, thus creating a descending connection line when such an opposed-action pump is arranged horizontally.

If, in contrast, the opposed-action pump described above is operated in a vertical position, the connection line between the second and the third pump stage is arranged horizontally, while the connection line between the third and the fourth pump stage is arranged on a downward slope.

A preferred embodiment according to the invention therefore envisages that the suction-side opening of the connection line provided in the second pump stage is arranged above the crank axis and/or the pressure-side opening of the connection line provided in the third pump stage is arranged below the crank axis.

To enable the condensate to be blown out continuously, the cross section of the connection lines between the comparatively small-configuration check valves should be designed in such a way that the gas velocity arising therein is sufficient to blow out the condensate. In the case of a descending or horizontal arrangement of the connection lines, this can lead to the lowest effective gas velocity. A preferred development according to the invention therefore envisages that the connection lines have a line diameter which is equal to or less than half the clear line cross section of the pressure or suction lines leading to the pressure or suction valves.

A preferred embodiment according to the invention envisages that the diaphragm suction pump has four pump chambers and/or is of four-stage design.

BRIEF DESCRIPTION OF THE DRAWINGS

Developments according to the invention will become apparent from the claims and from the drawing. The invention is described in greater detail below with reference to preferred embodiments.

In the drawings:

FIG. 1*a* shows a multi-stage diaphragm suction pump in a schematic plan view, wherein the pump stages of this suction pump are connected to one another by means of connection lines, which have suction- and pressure-side openings leading to the pump chambers, FIG. 1*b* shows the diaphragm suction pump from FIG. 1*a* in a schematic representation of the pump chambers thereof, wherein the arrangement of the pressure and suction valves and of the pressure- and suction-side openings of the connection lines is shown in the pump chambers, FIG. 1*c* shows the diaphragm suction pump from FIGS. 1*a* and 1*b* in a schematic side view looking toward the drive motor.

DETAILED DESCRIPTION OF THE PREFERRED EMBODIMENTS

Figure 2A:
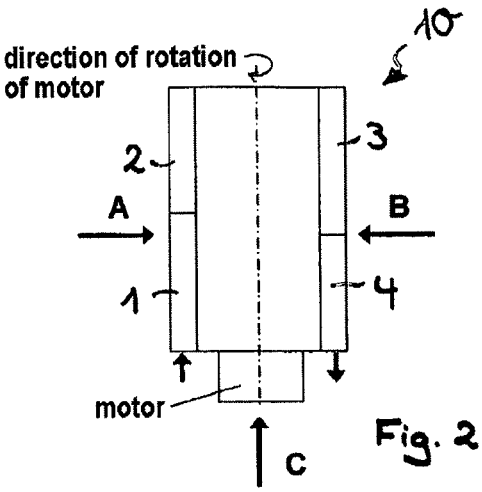
FIG. 2*a* shows a diaphragm suction pump comparable to FIGS. 1*a* to 1*c* in a schematic plan view.

In FIGS. 1 to 3 and 5 to 10, various embodiments of a multi-stage diaphragm suction pump 10, 100 are illustrated. The pump embodiments 10, 100 illustrated here each have four pump chambers 1, 2, 3 and 4, which are arranged in pairs in an opposed configuration. Each pump chamber 1, 2, 3, 4 of said pump embodiments has a fluid inlet 6 having an inlet valve and a fluid outlet 7 having an outlet valve. The fluid inlets 6 of the pump chambers 1, 2, 3, 4 are connected by a common suction line.

Moreover, the pump chambers 2, 3, 4, which follow one another in stages, are each connected to one another by means of a connection line 8, 9, 11 in such a way that, when a differential pressure in the suction line is reached or exceeded, the pump embodiments 10, 100 illustrated here change from parallel operation of the pump chambers 1, 2, 3, 4 thereof to an operating mode of said pump chambers 1, 2, 3, 4 that is at least also serial. At least one check valve, which opens to the downstream pump stage, is interposed in each of the inflow and outflow regions of the connection lines 8, 9, 11. The check valves and the pressure and suction valves provided in each pump chamber are controlled by the pressure differences of the medium to be delivered.

Figure 11:
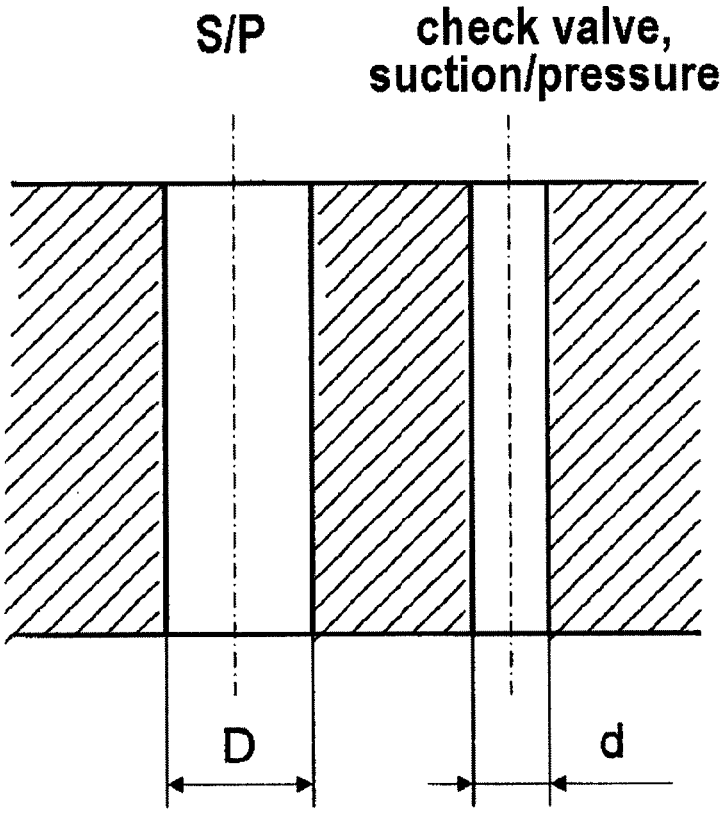
FIG. 11 shows a schematic comparison of the clear cross section of the connection lines provided between the pump stages, on the one hand, and of the inlet and outlet ducts leading to the suction valve or to the pressure valve, on the other hand.

As indicated in FIG. 11, the check valves provided in the inflow and in the outflow region of the connection lines 8, 9, 11 are of smaller design in comparison with the inlet and outlet valves of the pump chambers 1, 2, 3, 4, wherein a connection line segment open toward the adjacent pump chamber, having a smaller clear line cross section than the inlet and outlet valves, is assigned to each of said check valves. In their connection lines 8, 9, 11, which connect the pump chambers 1, 2, 3, 4 to one another, the diaphragm pumps illustrated here have check valves both on the inflow and on the outflow side, which are of significantly smaller dimensions than the inlet and outlet valves of said pump chambers 1, 2, 3, 4. Since the moving valve element of said check valves thus also has smaller moving masses and can accordingly respond more quickly, an approximation to the optimum changeover point between parallel and serial operation is significantly promoted. Since the connection lines 8, 9, 11 come into effect only in the region of the optimum changeover point, and since the connection lines 8, 9, 11 have to cope with only comparatively low delivery rates in this pumping phase, the clear cross section of the connection lines 8, 9, 11 can be made relatively small in comparison with the suction and the pressure line. This also makes it possible to embody the check valves provided in the at least one connection line 8, 9, 11 with a very small flow cross section and with a correspondingly small diameter in comparison with the suction and pressure valves. Due to the low mass of their moving valve or shutoff element, the check valves can thus respond quickly when the suction and pressure valves close and thereby prevent a situation where the pump embodiments illustrated here provide only inadequate delivery or none at all in a transitional range of the pressure differences. Since each of the check valves is assigned a line segment leading to the adjacent pump chamber which has a significantly smaller clear line cross section than the inlet and outlet valves, the remaining dead space between a check valve, on the one hand, and the adjacent pump chamber, on the other hand, can be kept so small that even the production of a very low ultimate vacuum is possible. The pump embodiments illustrated here therefore allow the production of as low an ultimate vacuum as possible in as short a time as possible by comparatively simple technical means.

FIGS. 3*a* to 3*c* and FIG. 5*b* show pump embodiments which correspond substantially to the prior art known hitherto with regards to the arrangement of the pump chamber openings leading to the connection lines. As will be clear from FIGS. 3*b* and 5*b*, the pressure- and the suction-side openings of the connection lines in the prior art known hitherto are provided approximately centrally between the pressure and the suction valves of the pump chambers, on a line arranged axially parallel with the axis of rotation of the connecting rod. Since the working diaphragm which rolls on the pump chamber wall reaches the openings 12, 13 of the connection lines 8, 9, 11 approximately only in the end position thereof in each pump chamber 1, 2, 3, 4, leakage flows can escape via said openings 12, 13 of the connection lines, exerting an unfavorable effect on the performance of these pump embodiments.

Figure 3A:
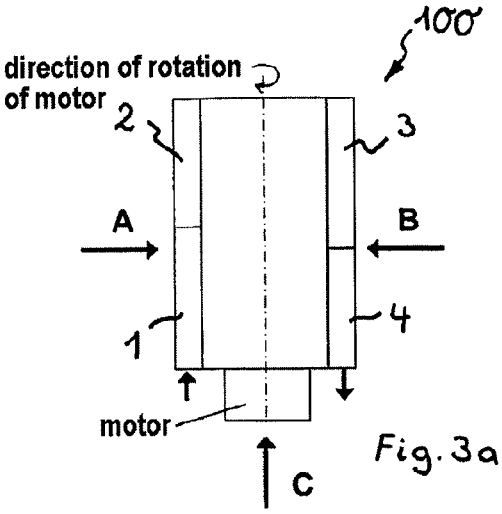
FIG. 3*a* shows a multi-stage diaphragm suction pump configured in accordance with the prior art in a schematic plan view.
Figure 3B:
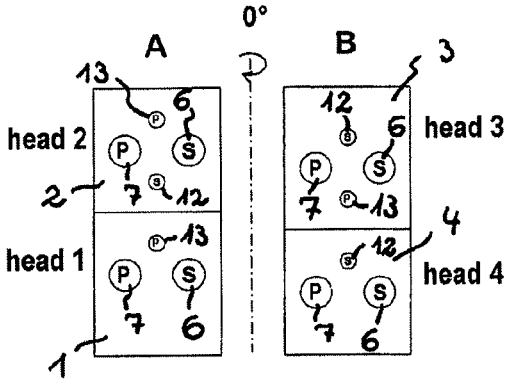
FIG. 3*b* shows the diaphragm suction pump from FIG. 3*a* in a schematic representation of the pump chambers thereof, wherein the arrangement of the pressure and suction valves and of the pressure- and suction-side openings of the connection lines is shown in the pump chambers and wherein the suction- and pressure-side openings of the connection lines provided between the pump stages are arranged virtually on a line lying between the suction and the pressure valve.
Figure 3C:
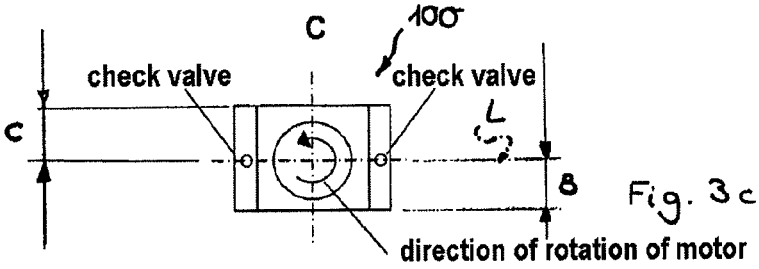
FIG. 3*c* shows the diaphragm suction pump from FIGS. 3*a* and 3*b* in a schematic side view looking toward the drive motor.
Figure 4:
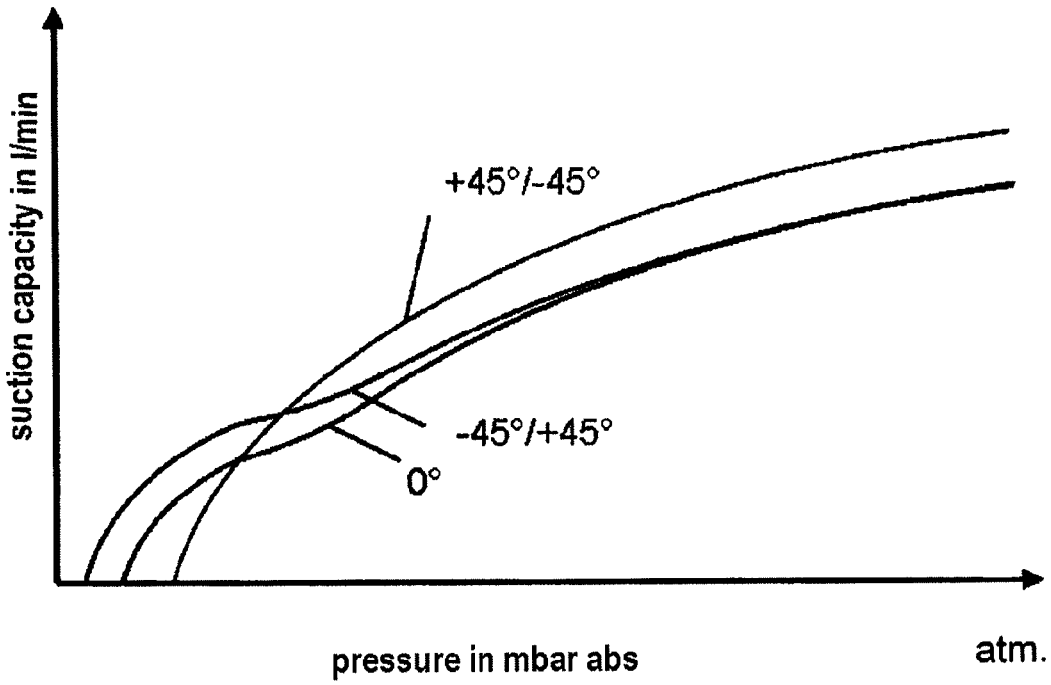
FIG. 4 shows the curve profile for the intake pressure and suction capacity of the diaphragm pumps illustrated in FIGS. 1*a* to 1*c*, 2*a* to 2*c* and 3*a* to 3*c*.

As will be clear from the curve profile for the intake pressure and the suction capacity, indicated by "0°" in FIG. 4, the pump embodiments shown in FIGS. 3*a* to 3*c* and 5*b* have a comparatively low intake pressure and, at the same time, also a comparatively low suction capacity.

FIG. 3*c* indicates that the pressure- and suction-side openings of the at least one connection line are arranged on a center line L oriented transversely to the connecting rod swivel plane. If FIG. 1*c* is compared with FIG. 3*c*, it will be clear that the intake pressure can be improved by turning the arrangement of the suction-side opening of the at least one connection line out of the center line L, which is oriented transversely to the connecting rod swivel plane at top dead center, e.g. through about −45° in a direction toward the region of the pump chamber in which the diaphragm associated with said pump chamber rolls first during a pump cycle. This region is indicated by "B" and "C" in FIG. 3*c*. In contrast, a comparison of FIGS. 2*c* and 3*c* makes clear that the suction capacity can be improved by turning the arrangement of the pressure-side opening of the at least one connection line out of the center line L, which is oriented transversely to the connecting rod swivel plane at top dead center, preferably through about +45° in a direction toward the region of the pump chamber in which the diaphragm associated with said pump chamber rolls first during a pump cycle. Here, the advantages desired can be achieved merely by turning the suction-side opening of the at least one connection line at least in the pump chamber of the pump stage which is second in the delivery direction in order to improve the intake pressure, or by turning the pressure-side opening at least in the pump chamber of the pump stage which is first in the delivery direction in order to improve the suction capacity.

In contrast, the pump embodiments 10 illustrated in FIGS. 1, 2, 5*c*, 5*d*, 7, 8, 9 and 10 are distinguished by pump characteristics which are optimized as regards the intake pressure or suction capacity thereof.

Thus, to improve the intake pressure in the pump embodiments shown in FIGS. 1, 5*c*, 7, 9 and 10, the suction-side opening 12 of the at least one connection line 8, 9, 11 is arranged in the region of the pump chamber, or in the vicinity of the region of the pump chamber, on which the diaphragm associated with said pump chamber rolls first during a pump cycle. The suction-side opening 12 is thus offset out of the longitudinal center plane of the pump, preferably by about 45°, in a direction toward the region of the pump chamber 2, 3, 4 and is thus arranged in the hemisphere of the pump chamber 2, 3, 4 in which the diaphragm D (FIGS. 1*a*, 1*c*) facing said pump chamber rolls first during a pump cycle.

The changeover from the parallel to the serial pumping mode of the multi-stage diaphragm pumps illustrated here takes place namely when the intake pressure in the following stage is lower than the discharge pressure in the previous stage. To enable this effect to occur, the crank angles of the crank mechanism associated with the connecting rod must be arranged offset from head to head, preferably by 180°. The closer the small suction-side opening 12 of a connection line 8, 9 or 11 then lies to the connecting rod oscillation plane, more specifically on the side of the sealing space on which the connecting rod is deflected in the direction of rotation by the tilting motion of the connecting rod during the upward stroke, and through the proximity to the connecting rod oscillation plane, the lower is the resulting intake pressure. The lowest intake pressure in the next stage is obtained if the small suction-side opening 12 of at least one connection line 8, 9, 11 lies precisely in the connecting rod oscillation plane. Each position between the zero point and the connecting rod oscillation plane results in a specific intake pressure. In this way, it is possible to influence the transition from the suction curve of the pump when connected in parallel to the suction curve when the pump is connected in series. At the same time, it is possible to exert an influence even if the arrangement of the suction-side opening 12 is shifted in the direction mentioned in only one of the pump stages 2, 3, 4. The process begins in the first pump stage 1 and progresses gradually via the other heads and pump stages 2, 3, 4. By means of the swivel angle, or variation thereof if required, in the arrangement of the suction-side opening 12 of the connection lines 8, 9, 11 connecting the pump stages 2, 3, 4 to one another in the direction of the connecting rod oscillation plane, it is possible to influence the transitional range in the curve profile of the intake pressure and the suction capacity.

Figure 2B:
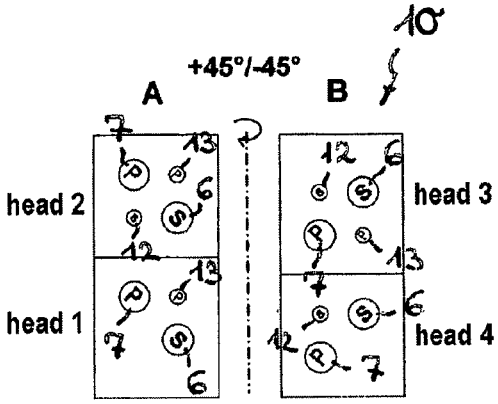
FIG. 2*b* shows the multi-stage diaphragm suction pump from FIG. 2*a* in a schematic representation of the pump chambers thereof, wherein the pressure-side openings of the connection lines are arranged offset in such a way in the pump chambers, in comparison with the arrangement shown in FIG. 1*b*, that a high suction capacity is promoted.
Figure 2C:
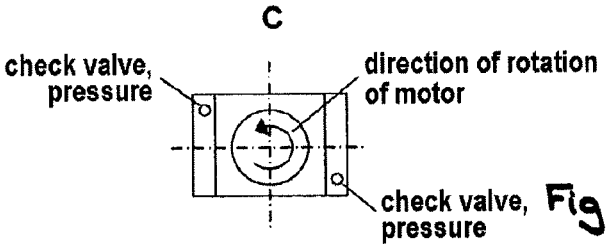
FIG. 2*c* shows the diaphragm suction pump from FIGS. 2*a* and 2*b* in a schematic side view looking toward the drive motor.
Figure 5A:
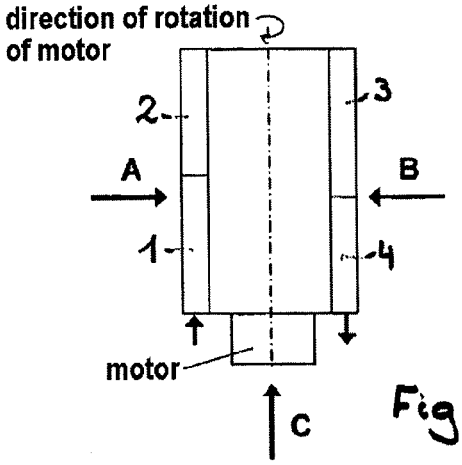
FIG. 5*a* shows a multi-stage diaphragm suction pump in a schematic plan view.
Figure 5E:
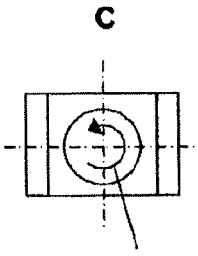
FIG. 5*e* shows a multi-stage diaphragm suction pump in a side view looking toward the drive motor.
Figure 5B:
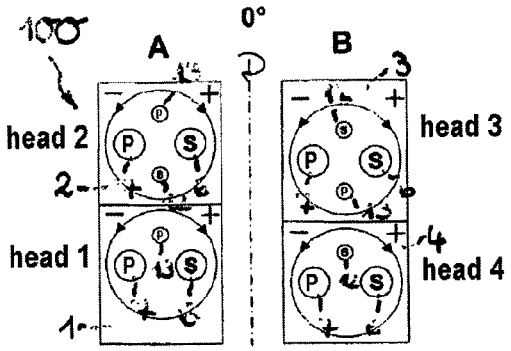
FIG. 5*b* shows a diaphragm suction pump in a schematic representation of the pump chambers thereof, comprising an arrangement of the suction and pressure valves and of the suction- and pressure-side openings of the connection lines comparable with that in FIG. 3*b*.
Figure 5C:
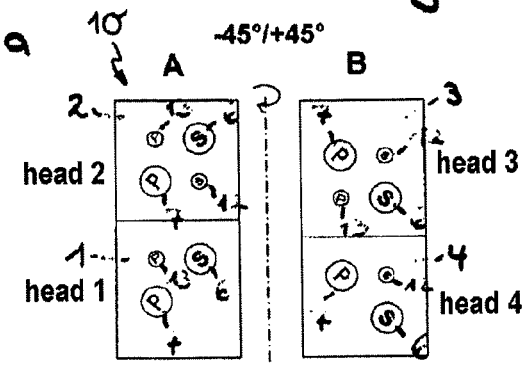
FIG. 5*c* shows a diaphragm suction pump in a schematic representation of the pump chambers thereof, wherein the arrangement of the suction and of the pressure valves and of the suction- and pressure-side openings of the connection lines corresponds to the arrangement shown in FIG. 1*b*.
Figure 5D:
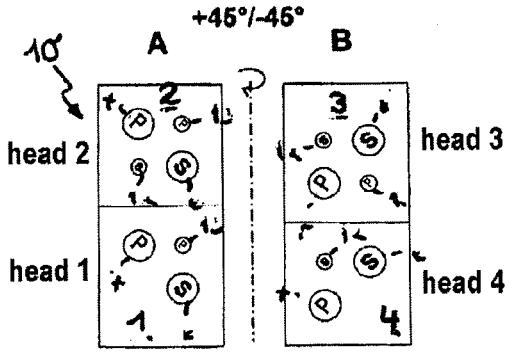
FIG. 5*d* shows a diaphragm suction pump in a schematic representation of the pump chambers thereof, wherein the arrangement of the suction and pressure valves and of the suction- and pressure-side openings of the connection lines corresponds to the arrangement shown in FIG. 2*b*.
Figure 8A:
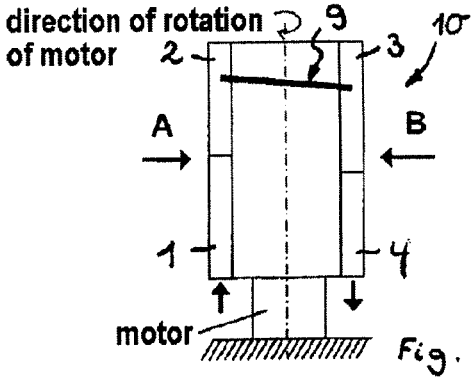
FIG. 8 shows an arrangement of the connection lines provided between the pump stages in a diaphragm suction pump of opposed, vertically arranged configuration in a schematic plan view (FIG. 8*a*) and in a schematic representation of the pump chambers thereof (FIG. 8*b*), said arrangement being particularly advantageous for blowing out the condensate which may arise in the successive pump chambers, wherein the arrangement of the pressure and suction valves and of the suction- and pressure-side openings of the connection lines corresponds to the arrangement shown in FIGS. 2*b* and 5*d*.

In the pump embodiments shown in FIGS. 2, 5*d* and 8, the intention is instead to improve the suction capacity. For this purpose, the pressure-side opening 10 of the at least one connection line 8, 9, 11, in at least one pump stage 1, 2, 3, 4, is arranged in the region of the pump chamber 1, 2, 3, 4, or in the vicinity of the region of the pump chamber 1, 2, 3, 4, on which the diaphragm associated with said pump chamber 1, 2, 3, 4 rolls first during a pump cycle. The pressure-side opening 13 is thus offset out of the longitudinal center plane of the pump, preferably by about 45°, in a direction toward the region of the pump chamber and is thus arranged in the hemisphere of the pump chamber in which the diaphragm associated with said pump chamber rolls first during a pump cycle.

FIG. 4 also shows the curve profile for the intake pressure and the suction capacity in the pump embodiments shown in FIGS. 1, 5*c*, 7, 9 and 10, on the one hand, and in the pump embodiments illustrated in FIGS. 2, 5*d* and 8, on the other hand. While the curve profile, indicated by "−45°/+45°", of the pump embodiments shown in FIGS. 1, 5*c*, 7, 9 and 10 is distinguished by an improved intake pressure, namely an additionally reduced intake pressure, the curve profile, indicated by "+45°/−45°", of the pump embodiments shown in FIGS. 2, 5*d* and 8 has an improved suction capacity.

As will be clear from a comparison of FIGS. 1, 2, 3, 5*c*, 5*d*, 7, 8, 9 and 10, the pressure- and the suction-side openings 12, 13 of the at least one connection line 8, 9, 11 and the suction valve provided in the fluid inlet 6 are arranged approximately on a line extending transversely to the connecting rod oscillation plane.

The diaphragm suction pumps 10, 100 illustrated here can be used as vacuum pumps, and often also for the purpose of pumping off moisture-laden vapors. In unfavorable pressure and temperature conditions, however, condensate may form in the last and the preceding stages 2, 3, 4. In the parallel mode of the diaphragm suction pumps 10, 100, the maximum ultimate pressure is usually higher than the evaporation pressure of the condensate. For this reason, the condensate does not yet have any influence on the evacuation process. In the serial mode of such diaphragm suction pumps, however, the ultimate pressure of the pump often falls below the evaporation point of the condensate, with the result that it is not possible to achieve the ultimate pressure owing to the re-expansion of the condensate.

In the pump embodiments shown in FIGS. 6 to 10, at least one connection line 8, 9, 10, in particular between successive pump chambers 2, 3, 4, is configured with a descending line progression, for which purpose the inflow-side line segment of said connection lines 8, 9, 11 is arranged at a higher level in comparison with the outflow-side line segment. This descending arrangement of the at least one connection line 8, 9, 11, in particular connection line 8, 9, 11 provided between successive pump chambers 2, 3, 4, makes it easier to blow out any condensate which arises in the successive pump chambers and additionally enhances the pump characteristic of the diaphragm suction pumps illustrated here in respect of the suction capacity thereof. In this arrangement, the condensate usually occurs close to atmospheric pressure and thus generally in the last three stages of the series-connected pump chambers of the multi-stage diaphragm suction pumps. The diaphragm suction pumps illustrated here are distinguished by a continuous evacuation process, even though any condensate is continuously blown out by the working gas itself. As will be clear from a comparison of FIGS. 9 and 10, the suction-side openings 12 of the connection lines 8, 9, 11 which are situated in the heads mounted on both sides of the pump housing must be arranged in the direction of the connecting rod oscillation plane and on the side of the head on which the connecting rod is deflected in the direction of rotation by the tilting motion during the upward stroke if optimization of the suction curve in respect of the intake pressure through modification of the changeover pressures by means of an offset arrangement of the openings of the connection lines 8, 9, 11 provided in the pump chamber 1, 2, 3, 4 is the aim. As a result, the suction-side opening 12 comes to lie above the axis in the second pump stage 2, while the pressure-side opening in the third pump stage 3 can be positioned below the axis, thus creating a descending connection line when such an opposed-action pump is arranged horizontally.

Figure 6A:
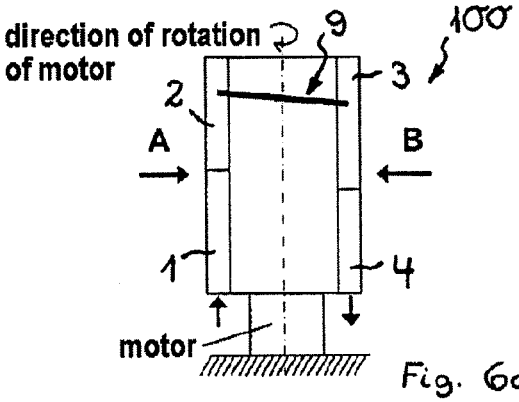
FIG. 6 shows an arrangement of the connection lines provided between the pump stages in a diaphragm suction pump of opposed, vertically arranged configuration in a schematic plan view (FIG. 6*a*) and in a schematic representation of the pump chambers thereof (FIG. 6*b*), said arrangement being particularly advantageous for blowing out the condensate which may arise in the successive pump chambers, wherein the arrangement of the pressure and suction valves and of the suction- and pressure-side openings of the connection lines corresponds to the arrangement shown in FIGS. 3*b* and 5*b*.
Figure 6B:
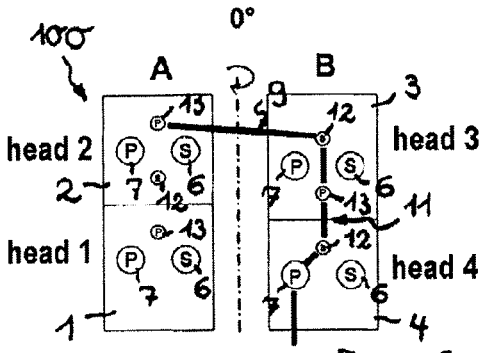
Figure 7A:
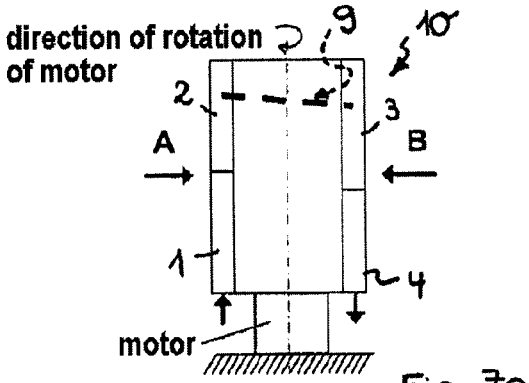
FIG. 7 shows an arrangement of the connection lines provided between the pump stages in a diaphragm suction pump of opposed, vertically arranged configuration in a schematic plan view and in a schematic representation of the pump chambers thereof, said arrangement being particularly advantageous for blowing out the condensate which may arise in the successive pump chambers, wherein the arrangement of the pressure and suction valves and of the suction- and pressure-side openings of the connection lines corresponds substantially to the arrangement shown in FIGS. 1*b* and 5*c*.
Figure 7B:
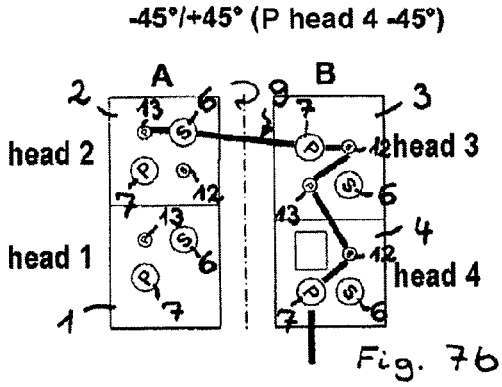
Figure 8B:
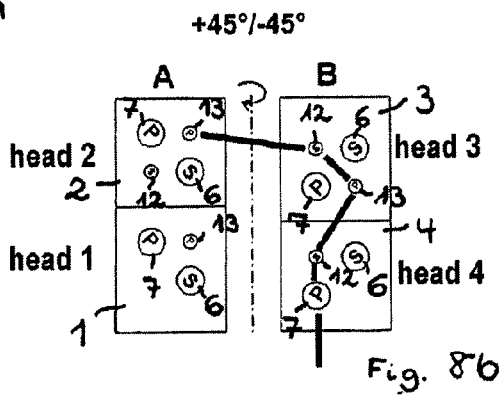
Figure 9A:
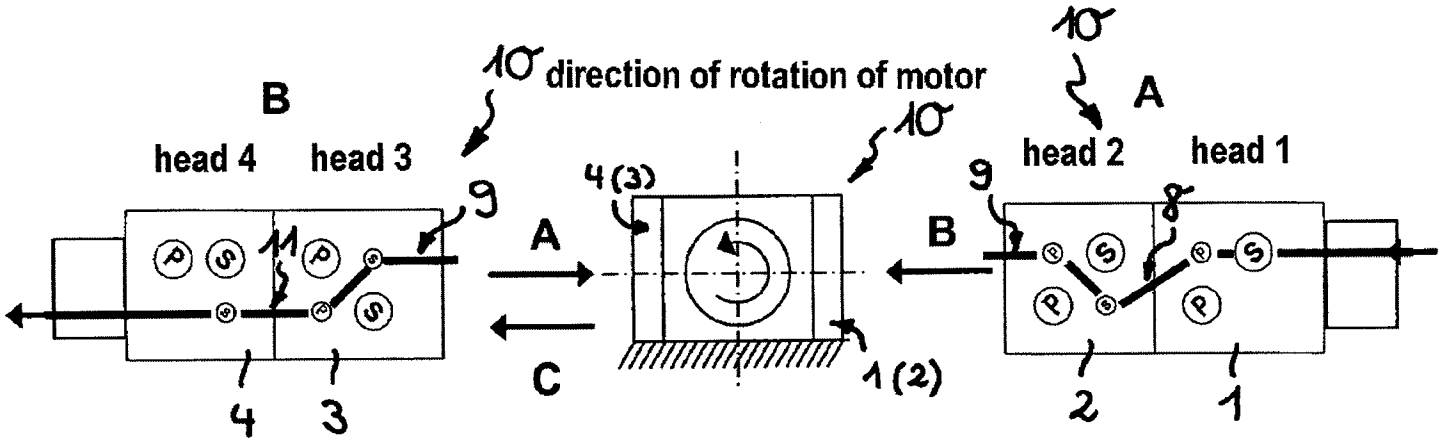
FIG. 9 shows an arrangement of the connection lines provided between the pump stages in a diaphragm suction pump of opposed, horizontally arranged configuration in a schematic side view (FIG. 9*a*) and in a schematic side view turned through 90° (FIG. 9*b*), said arrangement being particularly advantageous for blowing out the condensate which may arise in the successive pump chambers.
Figure 9B:
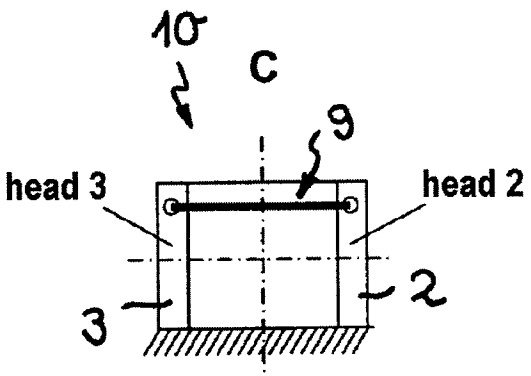
Figure 10A:
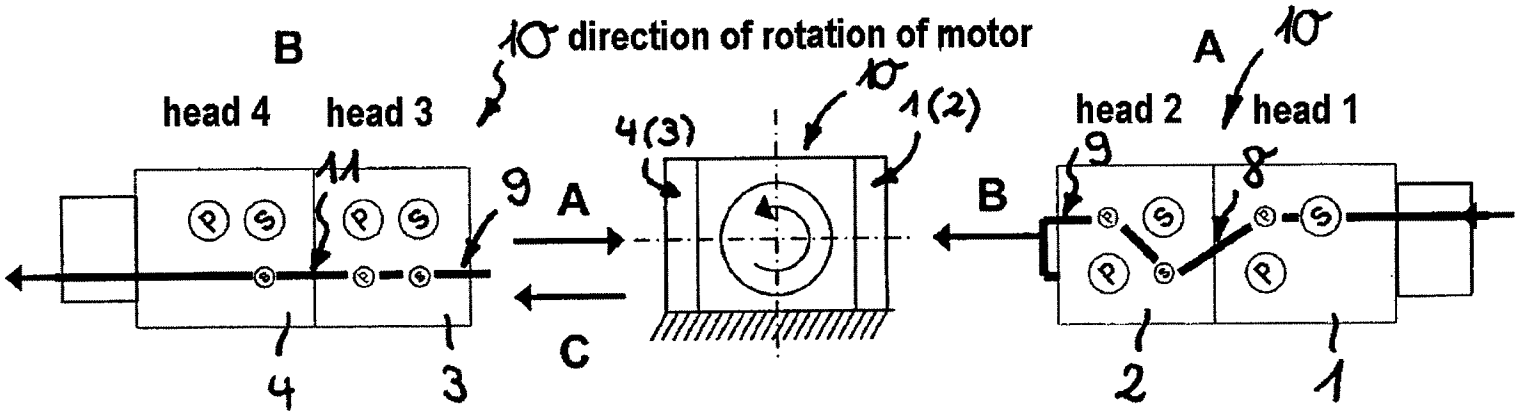
FIG. 10 shows a diaphragm suction pump comparable to that in FIGS. 9*a* and 9*b* in a schematic side view (FIG. 10*a*) and in a side view turned through 90° (FIG. 10*b*), wherein the pump stages of said diaphragm suction pump are connected to one another by means of connection lines arranged in a different way.
Figure 10B:
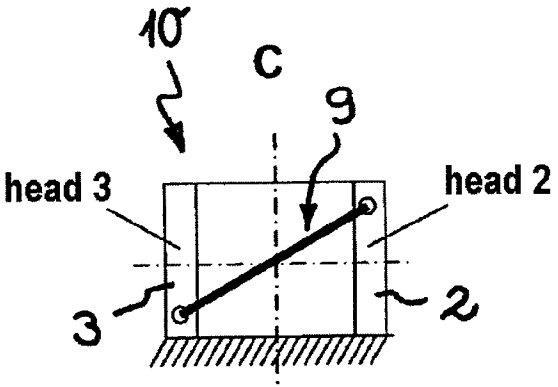

If, in contrast, the opposed-action pump described above is operated in a vertical position—as shown in FIGS. 6 to 8—the connection line 8 between the second and the third pump stage 2, 3 is arranged horizontally, while the connection line 9 between the third and the fourth pump stage 3, 4 is arranged on a downward slope. In this context, preference is given to an embodiment in which the suction-side opening 12 of the connection line provided in the second pump stage 2 is arranged above the crank axis and/or the pressure-side opening of the connection line provided in the third pump stage 3 is arranged below the crank axis (FIGS. 7*b*, 8*b*).

FIG. 11 illustrates schematically that the cross section d of the connection lines 8, 9, 11 between the relatively small-configuration check valves should be designed in such a way that the gas velocity occurring therein is sufficient to blow out the condensate. The connection lines of the pump embodiments shown here therefore have a line diameter d which is equal to or less than half the clear line cross section D of the pressure or suction lines leading to the pressure or suction valves. This ensures that the lowest effective gas velocity is achieved with a descending or horizontal arrangement of the connection lines 8, 9, 11.

The invention claimed is:

1. A multi-stage diaphragm suction pump (10), comprising at least two pump chambers (1, 2, 3, 4), each having a fluid inlet (6) having at least one inlet valve, and a fluid outlet (7) having at least one outlet valve, and comprising a suction line, which connects the fluid inlets (6) of the pump chambers (1, 2, 3, 4), wherein successive ones of the pump chambers (1, 2, 3, 4) are each connected to one another by at least one connection line (8, 9, 11) in such a way that, when a differential pressure in the suction line is reached/exceeded, the diaphragm pump (10) changes from parallel operation of the pump chambers (1, 2, 3, 4) thereof to an operating mode of said pump chambers that is at least also serial, and at least one check valve, which opens to a downstream pump stage, is interposed in each of inflow and outflow regions of the at least one connection line (8, 9, 11), and in order to improve an intake pressure, a suction-side opening (12) of the at least one connection line (8, 9, 11) or, in order to improve a suction capacity, a pressure-side opening (13) of the at least one connection line (8, 9, 11) at least in one of the pump chambers (1, 2, 3, 4) is arranged in a region (B, C) of the pump chamber (1, 2, 3, 4) on which a diaphragm associated with said pump chamber rolls first during a pump cycle and wherein the at least one connection line (8, 9, 11) between successive ones of the pump chambers (1, 2, 3, 4), has a descending line progression and an inflow-side line segment of said at least one connection line (8, 9, 11) is arranged at a higher level in comparison with an outflow-side line segment.

2. The diaphragm suction pump as claimed in claim 1, wherein a connecting rod that can be pivoted in a connecting rod oscillation plane is assigned to each of the pump chambers (1, 2, 3, 4) of the diaphragm pump (10), and at least in one of the pump chambers (1, 2, 3, 4), the suction-side or the pressure-side opening (12, 13) of the at least one connection line (8, 9, 11) is provided in the connecting rod oscillation plane.

3. The diaphragm suction pump as claimed in claim 2, wherein the suction-side or the pressure-side opening (12, 13) of the at least one connection line (8, 9, 11) is arranged in an edge region of the pump chamber (1, 2, 3, 4), which adjoins a clamping zone of the diaphragm.

4. The diaphragm suction pump as claimed in claim 1, wherein in order to improve the intake pressure, the suction-side opening (12) of the at least one connection line at least in the pump chamber (2) of the second pump stage in a delivery direction is arranged in a region of the pump chamber (2) of the second pump stage, or in the vicinity of the region of the pump chamber (2) of the second pump stage, on which the diaphragm associated with said pump chamber rolls first during a pump cycle.

5. The diaphragm suction pump as claimed in claim 1, wherein in order to improve the suction capacity, the pressure-side opening (13) of the at least one connection line at least in the pump chamber (1) of the first pump stage in a delivery direction is arranged in the region of the pump chamber stage (1) of the first pump, or in a vicinity of a region of the pump chamber stage (1) of the first pump, on which the diaphragm associated with said pump chamber rolls first during a pump cycle.

6. The diaphragm suction pump as claimed in claim 1, wherein the pump stages (1, 2, 3, 4) of the multi-stage diaphragm pump (10, 100) are arranged in pairs in an opposed configuration.

7. The diaphragm suction pump as claimed in claimed 1, wherein at least one of the suction-side opening (12) of the connection line (9) provided in the second pump stage (2) is arranged above a crank axis or the pressure-side opening (13) of the connection line provided in the third pump stage (3) is arranged below the crank axis.

8. The diaphragm suction pump as claimed in claim 1, wherein the connection lines (8, 9, 11) have a line diameter which is equal to or less than half of a clear line cross section of the pressure or suction lines leading to the pressure or suction valves.

9. The diaphragm suction pump as claimed in claim 1, the diaphragm suction pump (10, 100) has four pump chambers (1, 2, 3, 4).

10. The diaphragm suction pump as claimed in claim 1, wherein at least one suction- or pressure-side opening of the at least one connection line is provided in the first and in the last pump chamber (1, 4) of the successive pump chambers (1, 2, 3, 4), and at least one suction- and at least one pressure-side opening of the at least one connection line is provided in any pump chambers (2, 3) arranged therebetween.

11. A multi-stage diaphragm suction pump (10), comprising at least two pump chambers (1, 2, 3, 4), each having a fluid inlet (6) having at least one inlet valve, and a fluid outlet (7) having at least one outlet valve, and comprising a suction line, which connects the fluid inlets (6) of the pump chambers (1, 2, 3, 4), wherein successive ones of the pump chambers (1, 2, 3, 4) are each connected to one another by at least one connection line (8, 9, 11) in such a way that, when a differential pressure in the suction line is reached/exceeded, the diaphragm pump (10) changes from parallel operation of the pump chambers (1, 2, 3, 4) thereof to an operating mode of said pump chambers that is at least also serial, and at least one check valve, which opens to a downstream pump stage, is interposed in each of inflow and outflow regions of the at least one connection line (8, 9, 11), and in order to improve an intake pressure, a suction-side opening (12) of the at least one connection line (8, 9, 11) or, in order to improve a suction capacity, a pressure-side opening (13) of the at least one connection line (8, 9, 11) at least in one of the pump chambers (1, 2, 3, 4) is arranged in a region (B, C) of the pump chamber (1, 2, 3, 4) on which a diaphragm associated with said pump chamber rolls first during a pump cycle and wherein a connecting rod that can be pivoted in a connecting rod oscillation plane is assigned to each of the pump chambers (1, 2, 3, 4) of the diaphragm pump (10), and at least in one of the pump chambers (1, 2, 3, 4), the suction-side or the pressure-side opening (12, 13) of the at least one connection line (8, 9, 11) is provided in the connecting rod oscillation plane and wherein at least in one of the pump chambers (1, 2, 3, 4), the suction-side or the pressure-side opening (12, 13) of the at least one connection line (8, 9, 11) and the suction valve are arranged approximately on a line extending transversely to the connecting rod oscillation plane.

* * * * *